US010721990B2

(12) United States Patent
Campos et al.

(10) Patent No.: US 10,721,990 B2
(45) Date of Patent: Jul. 28, 2020

(54) FOOTWEAR SOLE STRUCTURE

(71) Applicant: NIKE, Inc., Beaverton, OR (US)

(72) Inventors: Fidencio Campos, Dallas, OR (US); Christopher D. Czech, Beaverton, OR (US); Zachary M. Elder, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 51 days.

(21) Appl. No.: 15/776,004

(22) PCT Filed: Nov. 11, 2016

(86) PCT No.: PCT/US2016/061601
§ 371 (c)(1),
(2) Date: May 14, 2018

(87) PCT Pub. No.: WO2017/083697
PCT Pub. Date: May 18, 2017

(65) Prior Publication Data

US 2018/0317600 A1 Nov. 8, 2018

Related U.S. Application Data

(60) Provisional application No. 62/255,354, filed on Nov. 13, 2015.

(51) Int. Cl.
*A43B 13/18* (2006.01)
*A43B 13/12* (2006.01)
(Continued)

(52) U.S. Cl.
CPC ..... *A43B 13/125* (2013.01); *A43B 13/181* (2013.01); *A43B 13/186* (2013.01);
(Continued)

(58) Field of Classification Search
CPC ... A43B 13/181; A43B 13/206; A43B 13/125; A43B 13/127; A43B 13/184;
(Continued)

(56) References Cited

U.S. PATENT DOCUMENTS 5,337,492 A * 8/1994 Anderie ..... A43B 13/181 36/114
7,314,125 B2 * 1/2008 Smaldone ..... A43B 13/183 188/372

(Continued)

FOREIGN PATENT DOCUMENTS

EP 0526892 A2 2/1993
WO 1999/033641 A9 9/1999

OTHER PUBLICATIONS

International Search Report and Written Opinion dated Jan. 20, 2017 in International Patent Application No. PCT/US2016/061601, 13 pages.

*Primary Examiner* — Ted Kavanaugh
(74) *Attorney, Agent, or Firm* — Shook, Hardy & Bacon LLP

(57) ABSTRACT

A sole structure for a footwear article includes round shell components. Each round shell component includes a network of ligaments that mechanically shift under load to attenuate a force or impact and that return to a resting state when the load is removed.

20 Claims, 4 Drawing Sheets

(51) Int. Cl.
*A43B 21/26* (2006.01)
*A43B 13/20* (2006.01)

(52) U.S. Cl.
CPC ..... *A43B 13/187* (2013.01); *A43B 13/189* (2013.01); *A43B 13/20* (2013.01); *A43B 21/26* (2013.01)

(58) Field of Classification Search
CPC ... A43B 13/186; A43B 13/187; A43B 13/189; A43B 13/20
USPC ..... 36/7.8, 27
See application file for complete search history.

(56) References Cited

U.S. PATENT DOCUMENTS

| | | | | |
|---|---|---|---|---|
| 7,779,558 | B2 * | 8/2010 | Nishiwaki | A43B 13/181 36/27 |
| 2006/0064900 | A1 * | 3/2006 | Aveni | A43B 13/183 36/28 |
| 2007/0033831 | A1 * | 2/2007 | Aveni | A43B 1/0072 36/28 |
| 2007/0119074 | A1 * | 5/2007 | Aveni | A43B 13/181 36/27 |
| 2008/0016718 | A1 | 1/2008 | Aveni et al. | |
| 2008/0016720 | A1 | 1/2008 | Aveni et al. | |
| 2014/0182170 | A1 | 7/2014 | Wawrousek et al. | |
| 2015/0033579 | A1 * | 2/2015 | Barnes | A43B 13/181 36/83 |
| 2015/0223560 | A1 | 8/2015 | Wawrousek et al. | |

* cited by examiner

FIG. 5A.
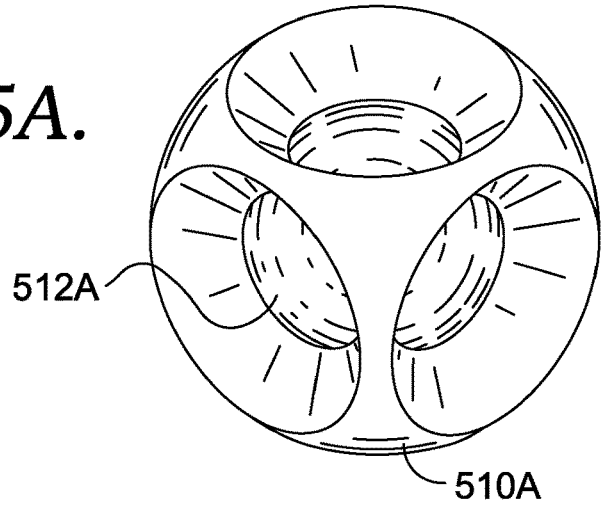
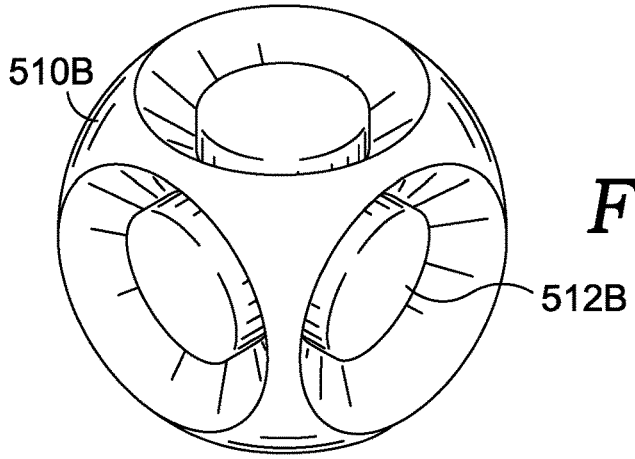
FIG. 5B.
FIG. 5C.
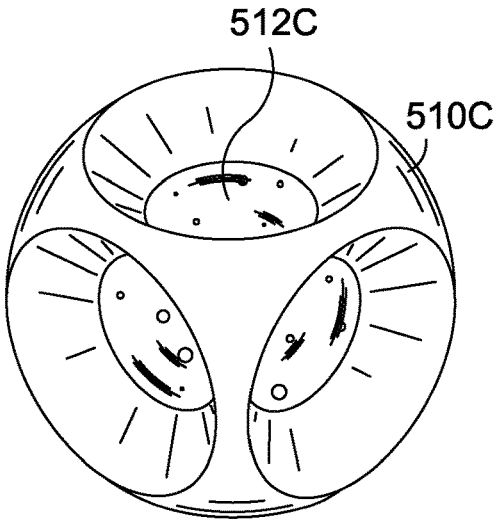

FOOTWEAR SOLE STRUCTURE

CROSS-REFERENCE TO RELATED APPLICATIONS

This U.S. Nonprovisional Application filed pursuant to 35 U.S.C. Section 371 claims priority to PCT Application No. PCT/US2016/061601 (filed Nov. 11, 2016), which claims the benefit of U.S. Provisional Application No. 62/255,354 (filed Nov. 13, 2015). The entirety of the aforementioned applications is incorporated by reference herein.

TECHNICAL FIELD

This disclosure relates to a footwear article, to a sole structure for the footwear article, and to a cushioning system for a footwear article.

BACKGROUND

Not Applicable.

SUMMARY

This disclosure is related to, among other things, a cushioning element for a footwear article, a cushioning system, a sole (e.g., midsole), a footwear article, a method of making any of the foregoing, and any combination thereof. Aspects described in this disclosure are defined by the claims below, not this summary. A high-level overview of various aspects of the disclosure is provided here to introduce a selection of concepts that are further described below in the detailed-description section. This summary is not intended to identify key features or essential features of the claimed subject matter, nor is it intended to be used as an aid in isolation to determine the scope of the claimed subject matter.

BRIEF DESCRIPTION OF THE DRAWINGS

This technology is described in detail herein with reference to the attached drawing figures, which are incorporated herein by reference, wherein:

FIGS. 5A-5C depict alternative shell components, each of which includes a respective additional impact-attenuation element in accordance with some aspects of this disclosure.

DETAILED DESCRIPTION

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

Figure 1:
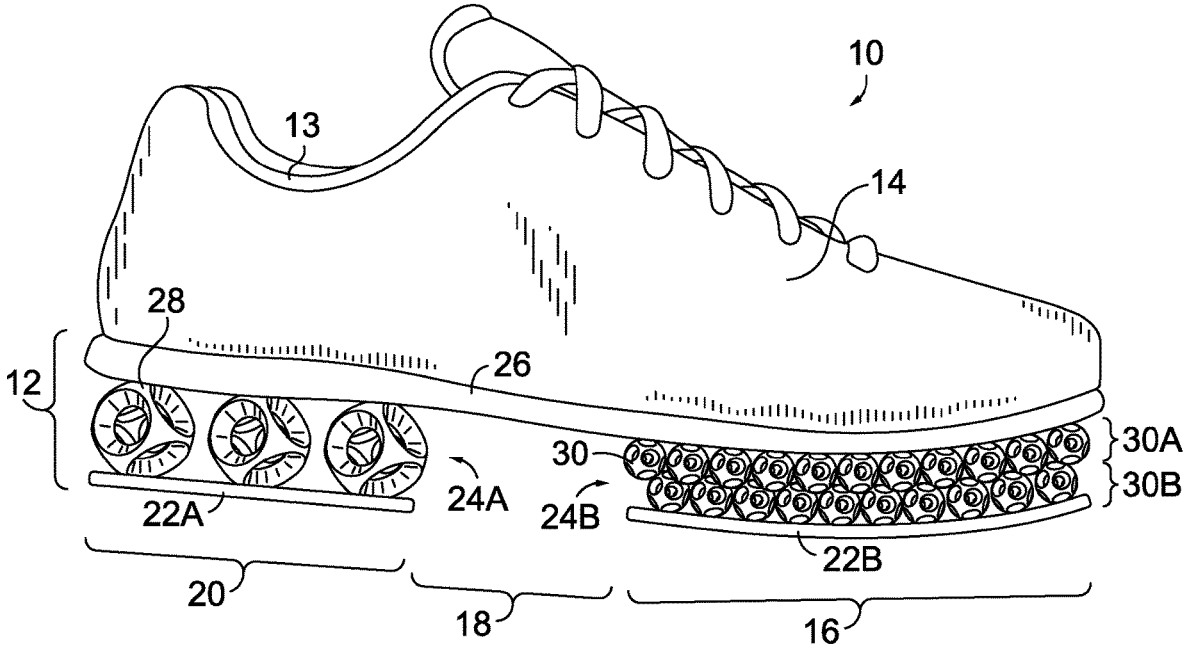
FIG. 1 depicts a side view of a footwear article in accordance with an aspect of this disclosure.

The subject matter described in this Specification generally relates to a sole structure and cushioning system for a footwear article, the sole structure including one or more round shell elements that attenuate a force or impact. An exemplary footwear article is depicted in FIG. 1. At a high level, shell components (e.g., shell component 28) attenuate the force or impact by mechanically deforming or changing states (e.g., buckling), and further aspects will be described in more detail in other parts of this Specification. Although FIG. 1 depicts one arrangement of various types of shell components, in other aspects of the technology the shell components may have different sizes, different hole patterns, and/or different layering structures than those depicted in FIG. 1. Moreover, the illustrative figures depict, and the Specification describes, certain styles of footwear, such as footwear worn when engaging in athletic activities (e.g., basketball shoes, cross-training shoes, running shoes, and the like). But the subject matter described herein may be used in combination with other styles of footwear, such as dress shoes, sandals, loafers, boots, and the like.

In FIG. 1, the footwear article 10 includes a shoe bottom unit 12 and an upper 14. The upper 14 and the shoe bottom unit 12 generally form a foot-receiving space that encloses at least part of a foot when the footwear is worn or donned. The foot-receiving space is accessible by inserting a foot through an opening formed by the ankle collar 13. When describing various aspects of the footwear 10, relative terms may be used to aid in understanding relative positions. For instance, the footwear 10 may be divided into three general regions: a forefoot region 16, a mid-foot region 18, and a heel region 20. The footwear 10 also includes a lateral side, a medial side, a superior portion, and an inferior portion. The forefoot region 16 generally includes portions of the footwear 10 corresponding with the toes and the joints connecting the metatarsals with the phalanges. The mid-foot region 18 generally includes portions of footwear 10 corresponding with the arch area of the foot, and the heel region 20 corresponds with rear portions of the foot, including the calcaneus bone. The lateral side and the medial side extend through each of regions 16, 18, and 20 and correspond with opposite sides of footwear 10. More particularly, the lateral side corresponds with an outside area of the foot (i.e., the surface that faces away from the other foot), and the medial side corresponds with an inside area of the foot (i.e., the surface that faces toward the other foot). Further, the superior portion and the inferior portion also extend through each of the regions 16, 18, and 20. The superior portion generally corresponds with a top portion that is oriented towards a person's head when the person's feet are positioned flat on the ground and the person is standing upright, whereas the inferior portion generally corresponds with a bottom portion oriented towards the bottom of a person's foot. These regions 16, 18, and 20, sides, and portions are not intended to demarcate precise areas of footwear 10. They are intended to represent general areas of footwear 10 to aid in understanding the various descriptions provided in this Specification. In addition, the regions, sides, and portions are provided for explanatory and illustrative purposes and are not meant to require a human being for interpretive purposes.

A shoe bottom unit 12 often comprises a shoe sole assembly with multiple components. For example, a shoe bottom unit 12 may comprise an outsole made of a relatively hard and durable material, such as rubber, that contacts the ground, floor, or other surface. A shoe bottom unit 12 may further comprise a midsole formed from a material that provides cushioning and absorbs/attenuates force during normal wear and/or athletic training or performance. Examples of materials often used in midsoles are, for example, ethylene vinyl acetate (EVA), thermoplastic polyurethane (TPU), thermoplastic elastomer (e.g., polyether block amide), and the like. Shoe soles may further have additional components, such as additional cushioning components (such as springs, air bags, and the like), functional components (such as motion control elements to address pronation or supination), protective elements (such as resilient plates to prevent damage to the foot from hazards on the floor or ground), and the like.

In FIG. 1, an exemplary shoe bottom unit 12 is depicted that includes an outsole 22A and 22B and a midsole 24A and 24B. In addition, the midsole 24A and 24B is coupled to a plate 26 to which portions of the upper 14 might attach to anchor the upper 14 to the shoe bottom unit 12. As previously indicated, an aspect of the present technology includes a midsole 24A and 24B having one or more spherical shell components 28 and 30, which attenuate force by at least partially buckling.

A spherical shell component, such as elements 28 and 30, included in the midsole of the shoe bottom unit 12 undergoes a structural transformation induced by buckling under a load, such as when the shoe 10 is worn and a person is standing, walking, running, jumping, etc. This structural transformation may be described in various manners. For example, in one aspect the spherical shell component is a three-dimensional (3D) auxetic structure, and the structural transformation includes an isotropic volume reduction brought about by the buckling under load. In this description, the term "auxetic" describes a structure that experiences a contraction under load in a direction that is transverse to the load. This is in contrast to non-auxetic materials that typically expand in a direction orthogonal to an applied load. The term "spherical" is used in various parts of this Specification to describe a three-dimensional body that is generally round but not necessarily perfectly round. That is, "spherical" does not necessarily mean that any given point on the body is the same distance from the center of the body.

The volume reduction of the spherical shell components under load is at least partially brought about by the structure of the spherical shell components. In this sense the spherical shell components are at least partially a metamaterial, such that the impact-attenuation functionality is derived from characteristics other than the underlying material (e.g., EVA or TPU)—although the characteristics of the underlying material may also contribute to the impact-attenuation functionality.

Figure 2A:
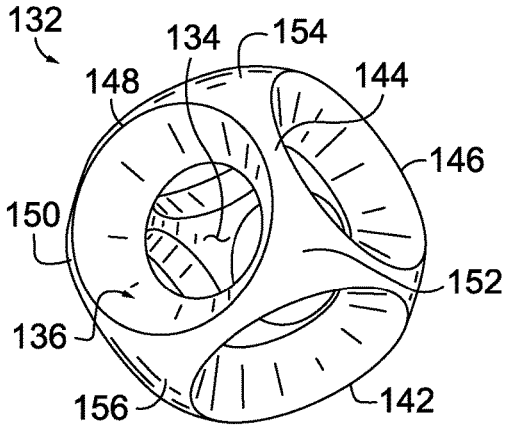
FIGS. 2A, 2B, and 2C depict different views of a six-hole shell component in accordance with an aspect of this disclosure.
Figure 2B:
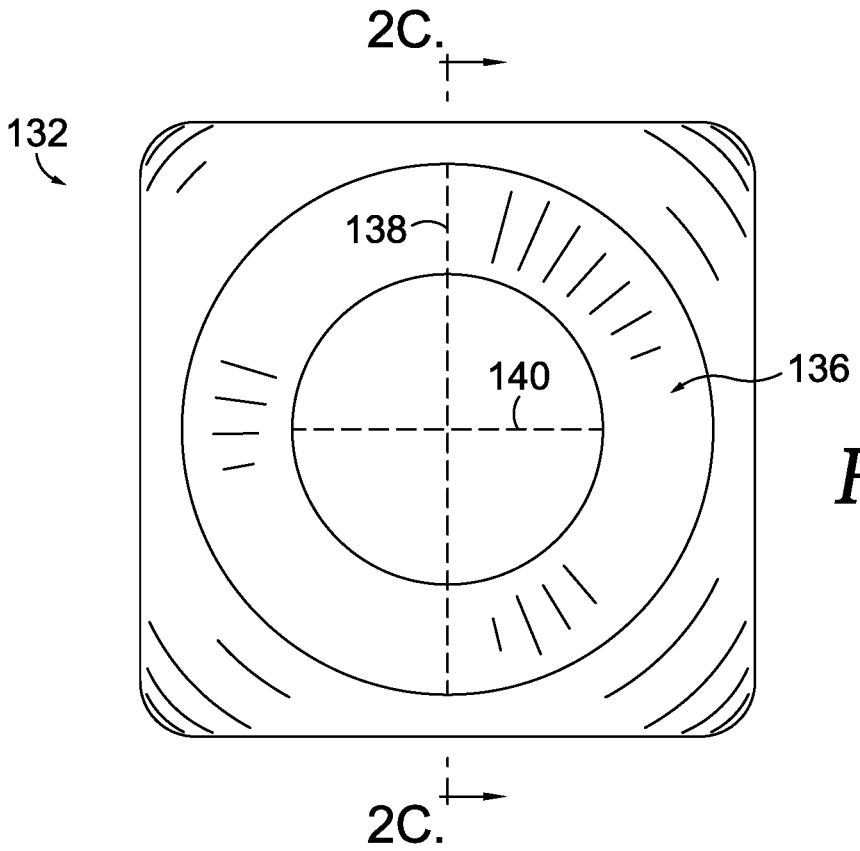
Figure 2C:
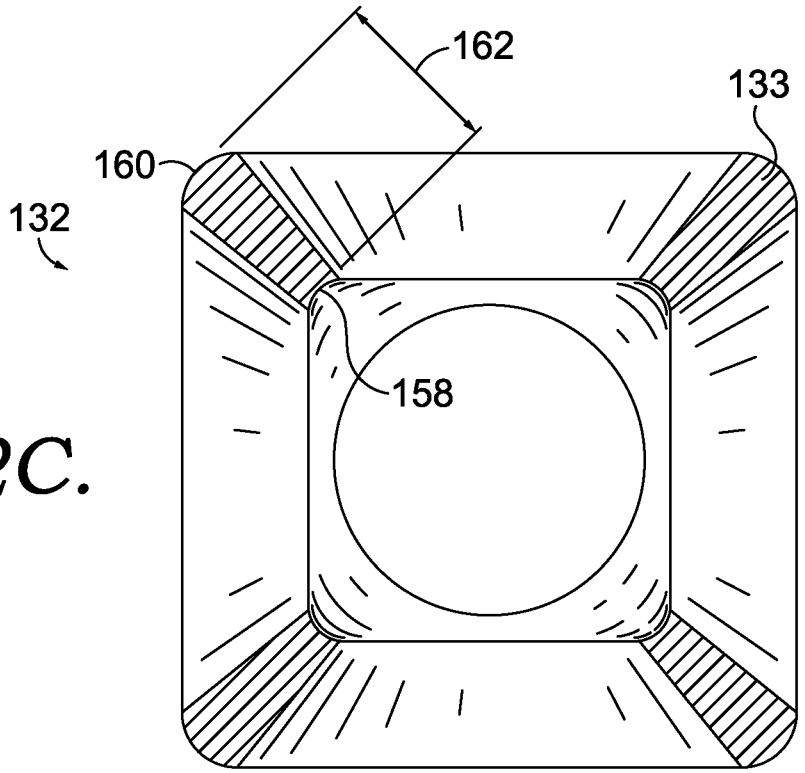

Reference is made to FIGS. 2A, 2B, and 2C (which show various enlarged views of the spherical shell component 28) to further describe some structure of a spherical shell component 132. FIG. 2A is a perspective view and FIGS. 2B and 2C provide a plan view and cross-sectional view (respectively). Generally, the structure of the spherical shell component 132 includes a shell wall 133 (FIG. 2C) that is constructed from a series of ligaments 142, 144, 146, 148, and 150 (some ligaments may be obscured from view and do not have numbers). The ligaments are joined at ligament junctions, such as junctions 152, 154, and 156, in a networked manner to form the shell wall, which at least partially encloses a cavity 134. In addition, the ligaments include an inward facing surface 158 (FIG. 2C) that faces towards the cavity 134 and an outward facing surface 160 that faces away from the cavity 134. Each ligament includes a thickness 162 (FIG. 2C) that extends between the inward facing surface and the outward facing surface. The ligaments might be constructed of various materials, such as elastomers, EVA, TPU, and the like. In addition, the ligaments might be referred to as being elastic or having elastic properties that allow the ligaments to bend, stretch, fold, and the like, in response to an applied load.

The shell wall also includes an array of circular voids 136 that are arranged throughout the shell wall and between the ligaments. Each circular void includes a first diameter 138 at the outward facing surfaces of ligaments that form a periphery around the void. In addition, each circular void includes a second diameter 140 at the inward facing surfaces of ligaments that form a periphery around the void. In one aspect, the first diameter 138 is larger than the second diameter 140, as illustrated in FIG. 2B.

In other aspects of the disclosure, the voids arranged throughout the shell wall may be non-circular. For example, the voids may include a polygon-shaped perimeter, such as four-sided voids or five-sided voids. In addition, the voids may have an organize-shaped perimeter. Similar to the arrangement discussed above, the void in the outward facing surface may be larger (e.g., larger area) than the void in the inward facing surface.

As previously described, the spherical shell component experiences a volume reduction when a load is applied. This volume reduction is brought about in part by a buckling cascade experienced by the ligaments, and the buckling of the ligaments absorbs at least part of the load (i.e., provides some impact attenuation). In addition, once ligaments have reached a substantially complete buckled state, the shell may compress as a whole to provide additional impact attenuation. Certain structural and geometric features of the spherical shell component help to provide the cascading buckling effect, which in turn provides impact attenuation. For example, in an aspect of the technology the number of holes in the array of holes is 6, 12, or 24, and this number of holes can affect the buckling and the impact-attenuation properties of the shell. The spherical shell component of FIGS. 2A-2C is a six-hole spherical shell component, and for illustrative purposes a twelve-hole spherical shell component 232 is provided by FIG. 3A and a twenty-four-hole spherical shell component 332 is provided by FIG. 3B. In a further aspect, each of these structures that are either six-hole, twelve-hole, or twenty-four-hole has octahedral symmetry.

For illustrative purposes, FIGS. 4A-4D depict the six-hole spherical shell component 132 at different stages of cooperative buckling. FIGS. 4A-4D collectively depict the progressive deformation and buckling of the ligaments at different stages and the resulting collapse of the circular voids. The amount of deformation, collapsing, and systematic volume reduction depends in a part on the magnitude of the load applied to the shell component. When the load is removed, each of the ligaments debuckles and return to its original state (e.g., FIG. 4A), in part due to the elastic nature of the material from which the shell component is constructed.

The type or amount of compression or volume reduction of a spherical shell component may depend on a system in which the spherical shell component is integrated, including the other components of a footwear article (e.g., outsole and midsole mounting plate), as well as additional shell components. For example, FIG. 1 depicts a system including other footwear components in which the spherical shell component 28 is integrated into the shoe bottom unit 12 and is coupled between the outsole 22A and the plate 26. Thus the attachment of the spherical shell component 28 to other portions of the shoe that have a different structure (e.g., possibly non-auxetic) may affect the amount or type of volume reduction or ligament-buckling cascade of the spherical shell component. For instance, the volume reduction may not be uniformly isotropic and/or the buckling of each ligament may not be exactly uniform.

In other systems, a plurality of shell components may be combined into layers of stacked shell components that are stacked, and the combination of shell components may affect the buckling of individual shells included in the system. In example of a combination of shell components is provided in FIG. 1, in which the footwear article 10 includes a top layer 30A of twelve-hole shell components and a bottom layer 30B of twelve-hole shell components. The layers of shell components may be stacked or arranged in various types of structures, each of which may perform differently as a system. For example, in one aspect the shell components are arranged in a lattice structure, and various types of lattice structures might be employed. In one aspect the lattice structures a based on cubic crystal systems. For example, a plurality of six-hole shell components may be stacked and layered in a body-centered cubic lattice between the outsole 22B and the plate 26; a plurality of twelve-hole shell components may be stacked and layered in a body-centered cubic lattice or in a simple cubic lattice between the outsole 22B and the plate 26; and a plurality of twenty-four-hole shell components may be stacked and layered in a body-centered cubic lattice, a face-centered cubic lattice, or in a simple cubic lattice between the outsole 22B and the plate 26.

In addition, the amount of impact attenuation provided by a shell component is tunable by adjusting various shell characteristics, such as the ligament thickness between the inward and outward facing surfaces and/or the length of the first and second diameters of the voids. For example, thicker ligaments may provide a "stiffer" shell component and/or a more responsive shell component.

In some other aspects of the disclosure depicted by FIGS. 5A, 5B, and 5C, the cavity 134 may be at least partially filled or occupied by another cushioning structure, which may also selectively tune the amount of impact attenuation provided by the shell. Similarly, one or more voids between the shell components may also (or alternatively) be at least partially filled or occupied by another element, which may also selectively tune the amount of impact attenuation provided by the shell. Filling or occupying the cavity may provide additional functionality as well, such as by impeding foreign objects from being lodged in the cavity and by supporting and reinforcing the ligaments.

In one aspect the cavity-occupying element may include one or more properties that cooperate with the shell component to achieve an amount of impact attenuation, cushion, responsiveness, and the like. For example, in one aspect the filler element includes a density that is not so high as to prevent any buckling or collapsing action by the shell component and that is not so low as to allow unimpeded buckling by the shell component. In addition, the filler element may include a resilience selected to either increase or decrease the responsiveness (e.g., bounce back) of the shell component and of the system as a whole. For example, the filler element may have a higher resilience than the shell component, such that the filler element actively increases the responsiveness of the shell component after buckling. In another example, the filler element may have a lower resilience than the shell component, in which case the filler element may dampen the responsiveness of the shell component after buckling. In another aspect, the cavity (or the voids between the shell components) may be occupied by another structural element having a unique cushion and resilience profile different than the shell component. For example, the cavity may be occupied by a spring element, columnar impact attenuator, smaller shell component, and the like.

Referring to FIGS. 5A, 5B, and 5C some illustrative filler elements, or cavity-occupying elements are depicted. For example, in FIG. 5A the cavity of the shell component 510A is filled or occupied by a core 512A, which may have various properties (e.g., density, resilience, elasticity, etc.) selected to cooperate with the impact-attenuation of the shell component 510A. The core 512A may be comprised of a foamed material or other material having a density that is not so high as to prevent any buckling or collapsing action by the shell component and that is not so low as to allow unimpeded buckling by the shell component. The core 512A may be a separate structure that is inserted into the cavity by passing the core 512A through one of the voids. Alternatively, the core 512A may be integrally formed with the ligaments and from the same material as the ligaments. A core element may be round, as depicted in FIG. 5A, or may include other geometries, as well. For example, in FIG. 5B a cavity of a shell component 510B is occupied by a core 512B, which also includes a boss or other structure configured to nest within the void in the shell wall. The core 512B may be formed from a material similar to the core 512A, such as a foamed material, or other material, having properties (e.g., density, resilience, elasticity, etc.) that cooperate with, and tune the functionality of, the shell component 510B. In another example illustrated by FIG. 5C, a cavity of a shell component 510C may be occupied by, or constructed to include, a filled bladder 512C. The filled bladder 512C may be a fluid-filled bladder (e.g., gas or liquid filled) or may include a loose fill of a solidified material (e.g., foamed beads). Again, the filled bladder may have various properties (e.g., density, resilience, elasticity, etc.) selected to cooperate with the properties of the shell component.

As depicted in FIG. 1, a footwear article may include different types of shell components within the same midsole. For example, FIG. 1 depicts an exemplary midsole in which the heel region 20 includes a series of six-hole shell components arranged in a single layer between the outsole 22A and the plate 26, and the forefoot region 16 includes a series of twelve-hole shell components arranged in a double-layered lattice between the outsole 22B and the plate 26. In FIG. 1 the twelve-hole shell components 30 are smaller than the six-hole shell components 28.

In other aspects of the technology, a footwear article may include shell components having different arrangements and characteristics than those depicted in FIG. 1. For example, the shell components that are included in the midsole may be substantially uniform throughout by having a same number of circular voids and having a same shell diameter. These shell components that are substantially uniform may be positioned in one or more regions of the midsole. For example, the shell components that are substantially uniform may be positioned in the heel portion or in the mid-foot portion or in the forefoot portion. Alternatively, the shell components that are substantially uniform may be positioned in both the heel portion and the forefoot portion, or in both the heel portion and the mid-foot portion, or in both the mid-foot portion and the forefoot portion. Further, the shell components that are substantially uniform may be positioned in the heel portion, in the mid-foot portion, and the forefoot portion, such that the substantially uniform shell components are positioned in all three of the regions, extending from near the anterior portion of the shoe to the posterior portion of the shoe.

Other aspects of the technology may include other variations from FIG. 1. For example, one portion of the midsole may include one or more shell components having a first set of characteristics, and another portion of the midsole may include one or more shell components having a second set of characteristics, which is different from the first set of characteristics. The first set of characteristics and the second characteristics may be different from one another in one or more aspects, including but not limited to number of holes, shell size (e.g., shell diameter), hole size, lattice type, ligament thickness, ligament width (i.e., distance between circular voids), lack of filler, presence of filler, different filler properties, and any combination thereof.

Various strategies may be utilized to apply the variability of shell characteristics from one portion of the midsole to another portion of the midsole, either fore-to-aft or medial-to-lateral. For instance, the heel portion may have a first set of shell components having a first set of characteristics, and the forefoot portion may have a second set of shell components having a second set of characteristics different from the first. The differences between the sets of characteristics may arise from various characteristics, including but not limited to a different number of holes, different hole size, different shell size, different lattice, different ligament thickness, different ligament width, presence of filler, different filler, or any combination of two or more of these differences. Furthermore, the mid-foot portion may have a third set of shell components having a third set of characteristics. The third set of characteristics may be the same as the first set or the same as the second set, or the third set of characteristics may be different from both the first set and the second set in any of the respects already described. These various combinations of different and/or similar sets of characteristics in different parts of the sole are only exemplary and are not meant to be exhaustive. Any combination of similar or different characteristics in the heel portion, mid-foot portion, and forefoot portion is intended to be included within the scope of this technology.

In a further aspect, the shell components within a same general region of the shoe may vary. For example, a heel portion may include one shell component on a medial side that includes a first set of characteristics and another shell component on a lateral side that includes a second set of characteristics that is different from the first set of characteristics. The mid-foot and forefoot portions may likewise include varied shell components within the same general region. In another example, the medial and lateral portions of a region (e.g., heel, mid-foot, and/or forefoot) may be the same or similar, and a central portion of the region, between the medial and lateral portions, may vary. Variations in shell characteristics within a same region may arise from various characteristics, including but not limited to a different number of holes, different hole size, different shell size, different lattice, different ligament thickness, different ligament width, presence of filler, different filler, or any combination of two or more of these differences.

In other aspects, the shell properties (e.g., size, hole number, hole size, material, ligament thickness, ligament width, lattice structure, filler, filler type, void structure, void fill, number of layers, etc.) may gradually change from one portion of the footwear to another portion of the footwear. For instance, the shell properties may gradually change from the medial side of the midsole to the lateral side of the midsole. In addition, the shell properties may gradually change from the heel portion to the mid-foot portion and/or from the mid-foot portion to the forefoot portion.

In a further aspect, the shell properties may change from one portion of the shell to another portion of the shell. For example, one side of the shell may have ligaments having a first thickness and geometry, which may gradually change as the network of ligaments transition to an opposing side of the shell. In this sense, the hole size within a single shell component may vary between two different holes constructed into the single shell component.

In an aspect of the technology, this variability of the shell component is usable to tune the performance of the midsole for an amount of impact-attenuation, an amount of responsiveness, and placement of impact-attenuation (e.g., lateral, medial, heel, forefoot, mid-foot, etc.).

The shell components may be combined with one or more other midsole structures. For example, shell components may be arranged in the heel portion of the midsole, and the forefoot and mid-foot portions might include another type of impact-attenuation structure (e.g., foam, spring, fluid-filled chamber, and the like). In one aspect, the shell components are arranged in a cartridge that is insertable and retainable between the outsole and another portion of the sole structure.

Although FIG. 1 depicts a footwear article having an upper 14 and a shoe bottom unit 12, other aspects of the present technology may be directed to the sole structure or shoe bottom unit without the upper. For example, another aspect is directed to a midsole portion that includes shell components and that can be combined with other sole components to construct a shoe bottom unit. Additionally, a further aspect includes a shoe bottom unit (e.g. outsole and midsole) that includes shell components and that can be coupled with an upper. Thus, some aspects may not include the upper or certain portions of the outsole or certain parts of the midsole.

The round shell components (e.g., 132, 232, and 332) might be manufactured using various techniques. For example, the shell components might be 3D printed using an additive technique or laser sintered. In addition, the shell component may be molded or cast. In one aspect, the shell is injection molded around a dissolvable core, which is dissolved after the ligaments are formed.

Subject matter set forth in this disclosure, and covered by at least some of the claims, may take various forms, such as a cushioning structure for a midsole, a cushioning system for a midsole, a midsole for a footwear article, a footwear article, any combination thereof, and one or more methods of making each of these aspects or making any combination thereof. Other aspects include a method of tuning a cushioning structure for a midsole, as well as a method of tuning a cushioning system for a midsole.

In one aspect, subject matter of this disclosure is directed to a sole for a footwear article, the sole including a plurality of round shell components (e.g., 2A, 3A, and 3B). Each round shell component in the plurality of round shell components includes ligaments that are connected at ligament junctions in a networked manner to collectively form a round three-dimensional body having a cavity. Each ligament includes an interior surface facing towards the cavity and an exterior surface facing away from the cavity and each ligament includes a ligament thickness extending between the interior surface and the exterior surface. In addition, each round shell component includes an array of voids positioned between the ligaments. Each void in the array of voids extends entirely from the exterior surface to the interior surface and includes a first void size at the exterior surface and a second void size at the interior surface.

In a further aspect, subject matter herein is directed to a cushioning system for a footwear midsole, the cushioning system including a first set of round shell components and a second set of round shell components. Each round shell component in the first and second set includes ligaments that are connected at ligament junctions in a networked manner to collectively form a round three-dimensional body having a cavity. Each ligament includes an interior surface facing towards the cavity and an exterior surface facing away from the cavity, and each ligament includes a ligament thickness extending between the interior surface and the exterior surface. Moreover, each round shell component includes an array of voids positioned between the ligaments, each void in the array of voids extending entirely from the exterior surface to the interior surface. Each round shell component in the first set of round shell components includes a first set of characteristics, and each round shell component in the second set of round shell components includes a second set of characteristics, which is different than the first set of characteristics.

Figure 3A:
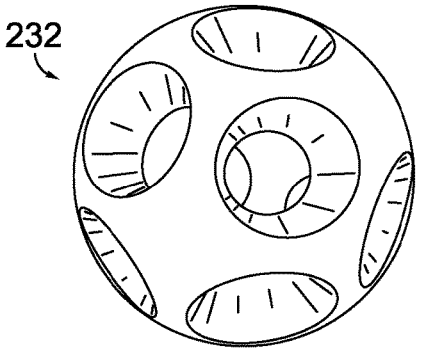
FIG. 3A depicts a twelve-hole shell component in accordance with an aspect of this disclosure.
Figure 3B:
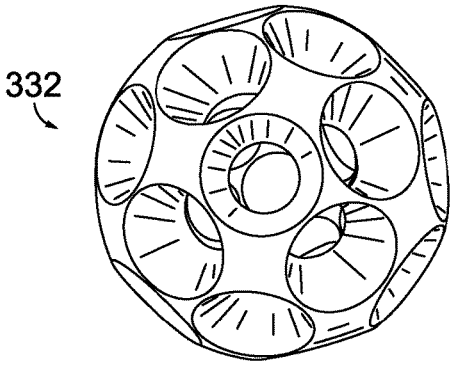
FIG. 3B depicts a twenty-four-hole shell component in accordance with an aspect of this disclosure.
Figure 4A:
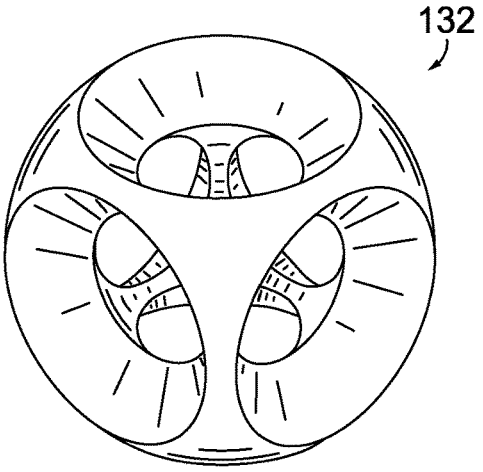
FIGS. 4A-4D depict the shell component of FIGS. 2A, 2B, and 2C in various states of buckling in accordance with an aspect of this disclosure.
Figure 4B:
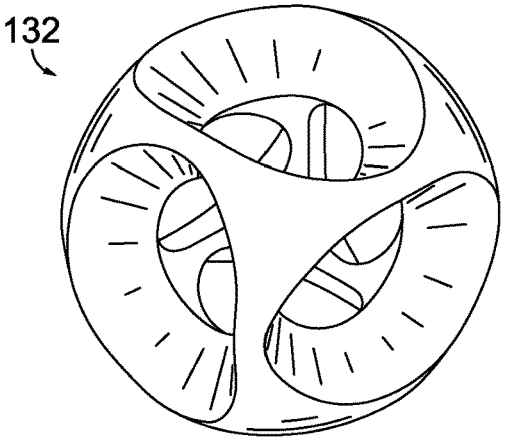
Figure 4C:
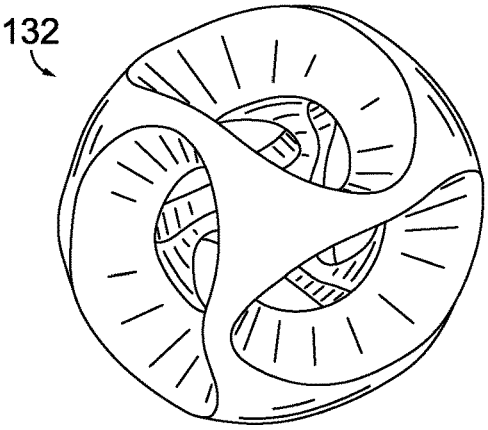
Figure 4D:
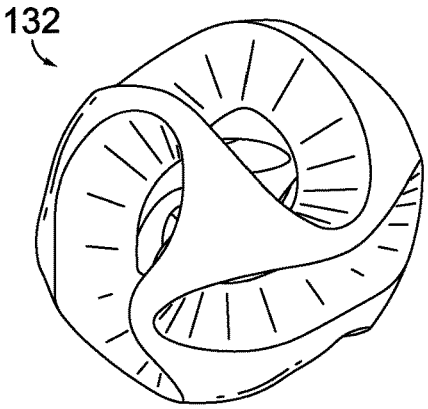

Another aspect of the disclosure is directed to a cushioning component for a footwear midsole, the cushioning component including a reversibly collapsible shell wall. The reversibly collapsible shell wall includes ligaments that are connected at ligament junctions in a networked manner to collectively form a round three-dimensional body. The ligaments at least partially enclose a cushioning-component core, and each ligament includes an exterior surface facing away from the core. The reversibly collapsible shell wall also includes an array of voids positioned between the ligaments, each void in the array of voids extending from the exterior surface towards the cushioning-component core. In some instances, the core may be hollow, such as depicted in FIGS. 2A, 3A, and 4A. In other examples, the core may include a foamed material, or a filled bladder (e.g., FIGS. 5A, 5B, and 5C).

From the foregoing, it will be seen that subject matter described in this disclosure is adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible alternative versions may be made of the subject matter described herein, without departing from the scope of this disclosure, it is to be understood that all matter herein set forth or shown in the accompanying drawings is to be interpreted as illustrative and not in a limiting sense.

What is claimed is:

1. A sole for a footwear article, the sole comprising:

a plurality of round shell components, each round shell component in the plurality of round shell components including:

ligaments that are connected at ligament junctions in a networked manner to collectively form a round three-dimensional body having a cavity, each ligament including an interior surface facing towards the cavity and an exterior surface facing away from the cavity and each ligament including a ligament thickness extending between the interior surface and the exterior surface; and an array of voids positioned between the ligaments, each void in the array of voids extending entirely from the exterior surface to the interior surface and including a first void size at the exterior surface and a second void size at the interior surface, wherein the first void size is larger than the second void size.

2. The sole of claim 1, wherein the array of voids includes a multiple of six voids and the round three-dimensional body comprises octahedral symmetry.

3. The sole of claim 1, wherein the voids comprise circular voids and the first void size includes a first diameter and the second void size includes a second diameter.

4. The sole of claim 1, wherein the plurality of round shell component includes a first set of round shell components and a second set of round shell components, wherein each round shell component in the first set of round shell components includes a respective round three-dimensional body having a first volume, and wherein each round shell component in the second set of round shell components includes a respective round three-dimensional body having a second volume that is smaller than the first volume.

5. The sole of claim 4, wherein the second set of round shell elements includes a first layer of round shell elements and a second layer of round shell elements, and wherein the first layer is stacked atop the second layer, such that the second layer is positioned between the first layer and an outsole.

6. The sole of claim 5, wherein the first set of round shell elements are positioned in a heel portion of the sole, and wherein the second set of round shell elements are arranged in a forefoot region of the sole.

7. The sole of claim 1, wherein the plurality of round shell component includes a first set of round shell components and a second set of round shell components, wherein each round shell component in the first set of round shell components includes a first array of voids having a first quantity of voids, and wherein each round shell component in the second set of round shell components includes a second array of voids having a second quantity of voids, which is greater than the first quantity and is a multiple of the first quantity.

8. The sole of claim 1, wherein the sole includes a heel portion, a mid-foot portion, and a forefoot portion, and wherein the plurality of round shell components are positioned in the heel portion, the mid-foot portion, the forefoot portion, or any combination thereof.

9. The sole of claim 8, wherein the plurality of round shell components are positioned within the heel portion, wherein the plurality of round shell component positioned within the heel portion includes a first set of round shell components and a second set of round shell components, wherein each round shell component in the first set of round shell components includes a first set of characteristics, and wherein each round shell component in the second set of round shell components includes a second set of characteristics, which is different than the first set of characteristics.

10. The sole of claim 8, wherein the plurality of round shell components are positioned within the mid-foot portion, wherein the plurality of round shell component positioned within the mid-foot portion includes a first set of round shell components and a second set of round shell components, wherein each round shell component in the first set of round shell components includes a first set of characteristics, and wherein each round shell component in the second set of round shell components includes a second set of characteristics, which is different than the first set of characteristics.

11. The sole of claim 8, wherein the plurality of round shell components are positioned within the forefoot portion, wherein the plurality of round shell component positioned within the forefoot portion includes a first set of round shell components and a second set of round shell components, wherein each round shell component in the first set of round shell components includes a first set of characteristics, and wherein each round shell component in the second set of round shell components includes a second set of characteristics, which is different than the first set of characteristics.

12. The sole of claim 8, wherein the plurality of round shell component are positioned within the heel portion, the mid-foot portion, and the forefoot portion and includes at least a first set of round shell components and a second set of round shell components, wherein each round shell component in the first set of round shell components includes a first set of characteristics, and wherein each round shell component in the second set of round shell components includes a second set of characteristics, which is different than the first set of characteristics.

13. The sole of claim 1, wherein the cavity is filled with another cushioning structure, and wherein the other cushioning structure includes a foamed material, a fluid-filled bladder, or any combination thereof.

14. The sole of claim 1, wherein the plurality of round shell components includes a first set of round shell components and a second set of round shell components, wherein each round shell component in the first set of round shell components includes a first set of characteristics, and wherein each round shell component in the second set of round shell components includes a second set of characteristics, which is different than the first set of characteristics.

15. The sole of claim 1, wherein each round shell component includes a cushioning-component core.

16. The sole of claim 15, wherein the cushioning-component core is hollow.

17. The sole of claim 15, wherein the cushioning-component core comprises a foamed material.

18. The sole of claim 17, wherein the ligaments are constructed of another material having different material properties than the foamed material.

19. A sole for a footwear article, the sole comprising:

a plurality of round shell components, each round shell component in the plurality of round shell components including:

ligaments that are connected at ligament junctions in a networked manner to collectively form a round three-dimensional body having a cavity, each ligament including an interior surface facing towards the cavity and an exterior surface facing away from the cavity and each ligament including a ligament thickness extending between the interior surface and the exterior surface; and an array of voids positioned between the ligaments, each void in the array of voids extending entirely from the exterior surface to the interior surface and including a first void size at the exterior surface and a second void size at the interior surface, wherein the array of voids includes a multiple of six voids and the round three-dimensional body comprises octahedral symmetry.

20. A sole for a footwear article, the sole comprising:

a plurality of round shell components, each round shell component in the plurality of round shell components including:

ligaments that are connected at ligament junctions in a networked manner to collectively form a round three-dimensional body having a cavity, each ligament including an interior surface facing towards the cavity and an exterior surface facing away from the cavity and each ligament including a ligament thickness extending between the interior surface and the exterior surface; and an array of voids positioned between the ligaments, each void in the array of voids extending entirely from the exterior surface to the interior surface and including a first void size at the exterior surface and a second void size at the interior surface, wherein the plurality of round shell components include a first layer of round shell components and a second layer of round shell components, and wherein the first layer is positioned between the second layer and an outsole.

* * * * *